United States Patent [19]

Hirmann

[11] 4,104,425

[45] Aug. 1, 1978

[54] POWER CELL DRIVEN BY A GASEOUS OR LIQUID PRESSURE MEDIUM

[75] Inventor: Georg Hirmann, Zurich, Switzerland

[73] Assignee: Rudolf Felix Homberger, Schaffhausen, Switzerland

[21] Appl. No.: 778,253

[22] Filed: Mar. 16, 1977

[51] Int. Cl.[2] ..... A47C 27/08; B63C 7/10

[52] U.S. Cl. ..... 428/12; 5/81 R; 9/13; 114/49; 114/53; 114/54; 428/35

[58] Field of Search ..... 428/12, 35; 5/81 R; 114/49, 53, 54; 9/13; 206/522

[56] References Cited

U.S. PATENT DOCUMENTS

| | | | |
|---|---|---|---|
| 2,743,510 | 5/1956 | Mauney et al. | 428/12 |
| 2,939,158 | 6/1960 | Baker | 9/13 |
| 3,008,214 | 11/1961 | Foster et al. | 428/12 |
| 3,575,776 | 4/1971 | MacIntyre | 428/12 |
| 3,705,645 | 12/1972 | Konen | 428/12 |
| 3,717,885 | 2/1973 | DeMare | 5/81 R |
| 3,775,781 | 12/1973 | Bruno et al. | 5/81 R |
| 3,978,531 | 9/1976 | Ilon | 5/81 R |
| 4,025,684 | 5/1977 | Neidhardt | 428/35 |

*Primary Examiner*—William R. Dixon, Jr.
*Attorney, Agent, or Firm*—Finnegan, Henderson, Farabow & Garrett

[57] ABSTRACT

A power cell for lifting masses by inflation of the cell by a gaseous or liquid medium, the cell being hollow and, in the pressure-free state, substantially a single plane. The cell includes two parallel polygonal surfaces, preferably squares, invariant in shape, interconnected by wall segments which vary in shape as the cell is inflated, the side wall segments forming partial cylindrical surfaces. The side wall segments and the polygonal surfaces are joined by transition wall surfaces to form a closed body. Various embodiments of the transition wall surfaces forming corner segments, are disclosed, wherein, in the pressure-free state of the cell, the extensions of the peripheries of adjoining side wall segments may intersect substantially rectilinearly, in a convex arc, in a concave arc, or in an obtuse angle.

12 Claims, 10 Drawing Figures

POWER CELL DRIVEN BY A GASEOUS OR LIQUID PRESSURE MEDIUM

BACKGROUND OF THE INVENTION

1. Field of the Invention

The present invention relates to a power cell, or lifting device for displacing masses, driven by a gaseous or liquid pressure medium, and in particular to a hollow body for lifting masses by inflation by gaseous or liquid pressure, the body being plane in the pressure-free state.

2. Description of the Prior Art

Power cells are known which are made of tension-resistant sheets of plastic foil which are combined, for example, by fusion to form a bellows. These known power cells are either designed as circular disks in top view or else the substantially circular top-view shape is formed by alternating concave and convex segments of the rim. If, as in the first design, the power cells are formed by two disk-like plastic foil sheets fused together along their circumference, they offer the advantage of easy machine-finishing but cause problems on account of the stresses in the foil occurring in the various lifting positions. These stresses are due to the operationally induced shortening of the circumference entailing tangential pressure forces, causing kinks at the cell rim beyond a critical height of lift corresponding to the seam segments. The magnitude of the critical height of lift at which the kinks arise, as well as their number and size, depend on the cell diameter, the curvature of the rim and furthermore on the pressure of the medium, the elasticity of the foil-wall and on any kink-stabilization effect of the foil-seam.

Since a meridian shortening of the girth of a free-standing power cell is unavoidable when the inside volume is enlarged, it has been necessary to achieve an appropriate distribution of the foil stresses and, furthermore, to prevent the occurrence of additional stresses by improving the cell construction.

Therefore, power cells were made in conformity with the second design, in which the tangential compression forces arising in the concave rim segments are eliminated at least in part by tangential tensional forces arising at the convex rim segments. At such a concave rim segment, obtained by suitably shaping the foil sheets, tangential forces acting normally to the seam are predominant, whereas tensions prevailing in the plane of the seam are in the convex parts, the peripheral shortenings being very readily absorbed in the concave rim segments by increasing the radii of curvatures. As a consequence, three-dimensional tensional stresses loading the seam relatively strongly occur in the transition zones from the concave to the convex segments.

SUMMARY OF THE INVENTION

The object of the present invention is to improve the design of the conventional power cells with respect to the aforesaid drawbacks. To that end, it is characterized in that the shape-varying cell wall segments assume the form of a developable geometric structure, such as part of the curved surface of a circular cylinder, when the power cell is inflated and changes in lift take place.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate at least one embodiment of the invention and, together with the description, serve to explain the principles of the invention. The invention is explained below in reference to the figures, in which.

DESCRIPTION OF THE PREFERRED EMBODIMENT

Reference will now be made in detail to the present preferred embodiment of the invention, an example of which is illustrated in the accompanying drawings.

Fundamentally, a power cell consists of a bellows, for instance formed by two flexible foil sheets combined, as by fusing, along their periphery to form a device for displacing masses as the device is filled with fluid under pressure. It is obvious that the optimum foil cell shape in theory is that of which the rim surfaces allow complete development. Since the generatrices of development surfaces under some circumstances may be straight lines intersecting only at infinity, these surfaces can be folded into a plane along one of these straight lines: for instance, cylindrical surfaces may be folded into plane rectangles and conical surfaces into sectors. But because there are no closed, completely developable surfaces, a closed surface may only be so conceived as consisting of as large as possible a proportion of developable surface segments in order to create only the smallest possible changes in length, and hence stresses, upon deformation into a plane.

Power cells preferably are designed to carry out a lift in a spatial direction. It follows from the statements above that the stresses occurring during lift in the foil sheets of the cell, or generally in the shape-varying closed surfaces, are the more problematical the more dimensional (for instance two dimensional) peripheral curvatures there are in the shape-varying surface segments. This can be seen from the fact that three dimensionally curved wall segments may be approximated by spherical surfaces in the sense of spheres of curvature, spherical surfaces being optimally stable in shape and not admitting changes in shape unless there be distortion.

If the power cell shape can be so designed that large parts of the shape-varying wall segments are peripherally curved only in two dimensions, then one obtains again the use of developable surfaces. Whereas cylindrical surfaces may be deformed in any direction orthogonal to their axis of symmetry—the axis of rotation in the case of circular cylinders—so that every intersection of the surface is deformed in one plane, an intersection of a cone on the other hand is always subjected to a three dimensional deformation. This shows that combining cylindrical and conical surfaces into a shape-varying closed structure must cause distortions and hence undesired shearing stresses in the transition zones, and that these effects must be kept as small as possible by selecting appropriate dimensions.

Figure 1:
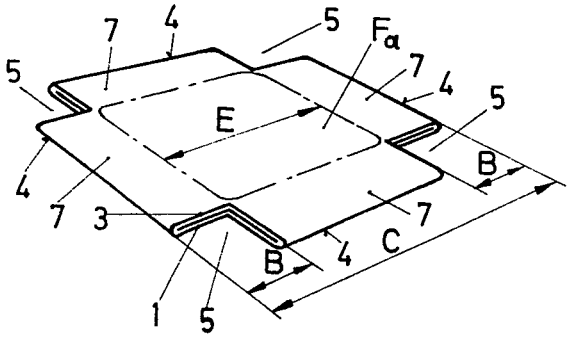
FIG. 1 is a perspective of the basic shape of the power cell, the corner-parts being omitted for theoretical considerations.

FIG. 1 shows the basic shape of a power cell, the design of the corners being discussed later. The power cell comprises two foil sheets 1, 3 which are contiguous in the unpressurized state of the cell. Foil sheets 1, 3 basically are made square with a length of side C and are connected along their edges, for instance, by being joined together at seams 4. Both foil sheets 1, 3 are recessed at the four corners of their squares to form right-angle recesses 5 of equal sides B, the recesses themselves being of square shape and having their sides B parallel to the sides C of the basic square. In this manner, one obtains the basic shape of a cross with four equal legs 7 formed by the recesses 5. The inward facing corners of recesses 5 in turn determine a central square having a central cross surface $F_a$ of which each side is of a length E.

Figure 2:
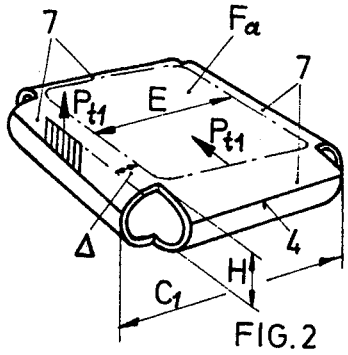
FIG. 2 is a perspective of the power cell of FIG. 1 with the corner-part omitted for theoretical considerations, upon initiating a certain lift.

FIG. 2 illustrates the changes in a power cell of the basic shape of FIG. 1 when the two foil sheets 1, 3 separate from one another when a lift of distance H is applied. Legs 7 of the basic cross-shaped surface, as shown in FIG. 1, are at least partially deformed into substantially circular cylindrical surfaces of radius $\frac{1}{2}$H. The initial top view length of the sides C is shortened to $C_1$, approximately given by the following expression (neglecting foil thickness and any portions of the legs 7 not developed into a cylinder of the lift H):

$$C_1 = C - H(\tfrac{1}{2}\pi - 1)$$

The square formed by the internal corners of recesses 5 with lengths of sides E is the actual active surface $F_a$. For ease of computation this surface is made equivalent to the force required to achieve the lift H with the pressure P being at a medium pressure p, namely $$F_a = P/p$$

The operational volume then is given by $$V_a = F_a \cdot H$$

The parts of the legs 7 not developed into a cylinder and assumed to be still remaining plane, of the surface $F_a$, in the presence of lift H are given by $$\Delta = B - \tfrac{1}{4}\pi H$$

so that the filling volume is given by $$V_f = V_a + 4\,(H\,\Delta\,E + \tfrac{1}{8}\pi \cdot H^2 \cdot E);$$

and upon inserting $V_a$ $$V_f = E^2H + 4\,(H \cdot \Delta \cdot E + \tfrac{1}{8}\pi \cdot H^2 \cdot E).$$

If now the expression found for Δ is inserted, one obtains $$V_f = E^2H + 4\,H \cdot E\,(B - [\pi/8] \cdot H);$$

Since Δ would be very small as compared with B, for purposes of this development $$B = \pi H/4 \text{ and } H = 4B/\pi$$

when this value of H is substituted in the last equation $$V_f = E_2H + 2\,H \cdot B \cdot E$$

The volumetric efficiency $U_{eff}$ may now be computed from the operational volume $V_a$ and the filling volume $F_f$ $$U_{eff} = V_a/V_f = E^2H/(E^2H + 2\,HBE) = E/(E + 2B);$$

and indicating that the volumetric efficiency is independent of the lift and can be determined by appropriately selecting the dimensions of the foil-cross of FIG. 1.

The following tensional stresses occur in the cylinder wall, $$P_{tl} = \tfrac{1}{2}H \cdot p$$

where $p$ is the inside pressure. These considerations clearly show the advantages of so shaping power cells that the developable surfaces comprise as far as possible of cylindrical surfaces since only unidimensional tensional stresses occur in such parts. There will be a description below regarding the desirable shape of the corner portions so as to minimize the necessarily occurring two-dimensional stresses these corners occasion in the transition segments.

Be it noted here that obviously the basic shape of the power cell may be designed to be not only square, but also rectangular, triangular or generally polygonic.

Figure 3:
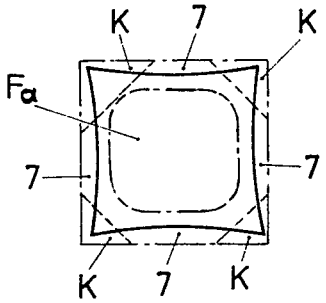
FIG. 3 is the top view of a power cell with a basic design as in FIG. 1 and with a rectilinear seam.

FIG. 3 shows the power cell, according to the invention which is square in the unpressurized state. The dash-dot lines correspond to its topview shape when the lift $H = 0$, whereas the solid lines or contours represent shape for maximum lift, $F_a$ again being the active surface.

Figure 4:
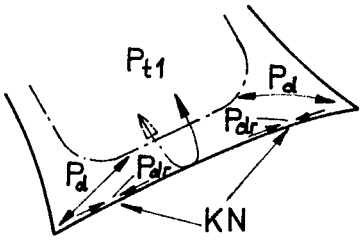
FIG. 4 is part of a perspective of a power cell corresponding to FIG. 3, indicating the stresses and the most loaded zones.

FIG. 4 shows the stresses taking place in a power cell of FIG. 3. Because of the spreading of cones K forming the corners and the lift causing a substantially distortion-free transition to adjoining cylinder surfaces formed from legs 7, the topview diagonal length is shortened according to the upward slope of the diagonal-cone generatrix, the generatrices of the cones in the plane orthogonal to the direction of lift also necessarily being shortened. Thus are generated diagonally directed tensional stresses $P_d$ mainly along the diagonal generatrices, and further compressional stresses $P_{dr}$ in the main along the cone generatrices orthogonally to the direction of lift, at the transition zones to the cylinder generatrices.

The tangential stresses $P_{tl}$ in the cylinder walls arise in legs 7, which correspond to the developable cylindrical surfaces, and on these tangential stresses are superposed at the corners compressional stresses $P_{dr}$, causing kinks in the zones of transition from the conical surfaces to the cylindrical wall segments, said transition zones being denoted by KN.

The prevailing risk of kinking at the transition zones may be minimized by shaping the power cell, not as a square when viewed from above, but rather with the corner terminations formed as conical surfaces with the smallest possible aperture angle. The sharper the corner cones K, the lesser the lift-induced shortening of the diagonal and the resultant tensional and compressional stresses. However, the volumetric efficiency is also degraded thereby and the diagonal of the power cells appreciably lengthened without any additional useful effect.

Figure 5:
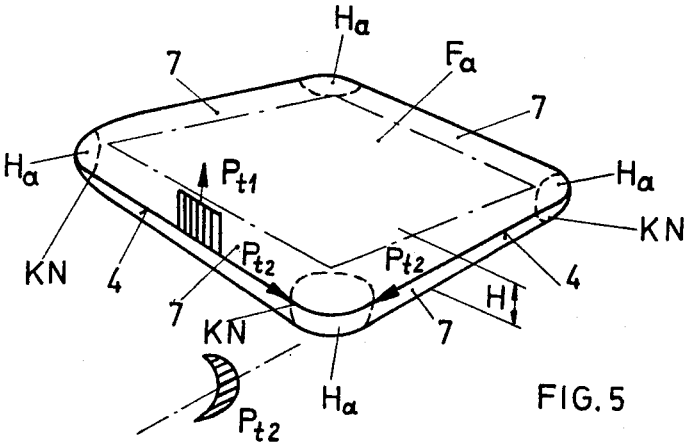
FIG. 5 is a perspective of a power cell with a basic design as in FIG. 1 and with convexly rounded-off corner seams, also indicating the stresses.

FIG. 5 is a perspective of the power cell according to the invention which is essentially square in shape, with corner segments formed by convexly rounded hoods $H_a$. Again the tensional stresses in this figure are denoted by $P_{t1}$ which occur in the foil segments shaped as cylindrical surfaces and the kink-inducing compressional stresses by $P_{t2}$. Their approximate distributions also are shown.

Figure 6:
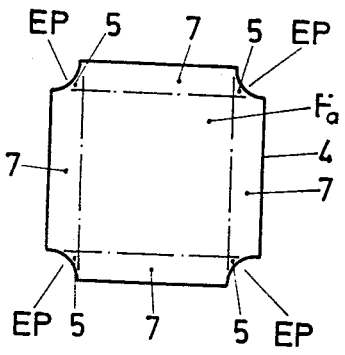
FIG. 6 is the top view of a power cell with a basic shape as in FIG. 1 and with concavely rounded-off corner seams.
Figure 7:
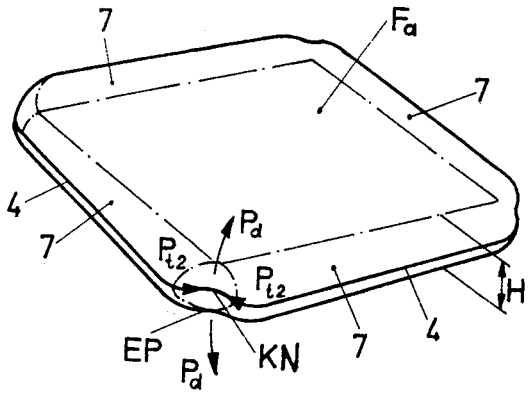
FIG. 7 is a perspective view of a inflated power cell corresponding to FIG. 6, indicating the stresses.

FIGS. 6 and 7 illustrate another embodiment of the power cell according to the principles of the invention. The corner terminations in this instance are in the form of concavely rounded-off corner segments EP. This eliminates practically any danger of kinking, because a lift-induced meridian peripheral shortening allows said concavely-rounded corner segments EP to readily absorb radii of curvatures increasing according to the lift H.

FIG. 7 shows the stresses occuring at the rim segments. Diagonally directed tensional stresses $P_d$ prevent compressional stresses $P_{t2}$ from causing kinks orthogonally to the direction of lift. The foil segments of corner parts EP located in the diagonal of the square basic foil shape are stressed most, namely orthogonally to seam 4, and therefore these seam sites are the most critical locations.

Figure 8:
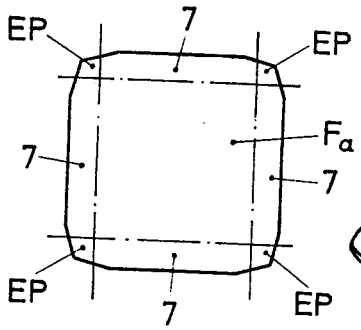
FIG. 8 is a top view of a power cell with a shape corresponding to that in FIG. 1 and with beveled corner seams.
Figure 9:
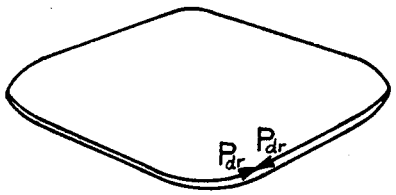
FIG. 9 is a perspective of a top view of the power cell corresponding to FIG. 8.

FIGS. 8 and 9 illustrate still another embodiment of a power cell according to the invention. Whereas the basic shape again corresponds to that in FIG. 1, the corners EP are formed as obtuse angles. This shape offers the following advantages: in contrast to the power cells shown in FIG. 3 and of square shape for lift $H = 0$, a bevelled-corner power-cell is of lesser diameter for the same magnitude of the active surfaces $F_a$, so that the overall volumetric efficiency is improved providing greater compactness.

In the square power cell of FIG. 3 and as shown in FIG. 4, compressional stresses are in effect at the critical sites KN. In the embodiment of FIG. 3, the aperture angle of corner cones K becoming smaller in the plane normal to the direction of lift as the lift increases, the generatrices necessarily will become curved concavely at the critical sites KN. However, the least tendency toward concave curvature induces shortening-caused compressional stresses $P_{dr}$ which in turn set up forces toward the inside of the power cell. This makes it clear that in a square-shaped powercell, the arising compressional stresses induce kinking of the cell walls in direction of the cell inside.

In contrast to this condition, the compressional forces of the power cell with obtuse-angle corner terminations are directed in such manner that their resultant tends to force the cell-wall outward. If such a power cell is pressure-loaded to carry out a given lift, the generatrices of the cylindrical surfaces corresponding to legs 7 again will contract toward the center of the cell, the corner segments becoming increasingly more arched thereby, until the power cell evidences a square top-view at a given lift, together with rounded corners. If this particular lift is exceeded, kinks again will form according to the shape of the power cell shown in FIG. 5. It is evident therefore that the most effective lift of a power cell with bevelled corner-shape is defined by the one for which the cell is square in top view.

Besides the cited improvement of volumetric efficiency there will be no danger of kinking the cell wall of such a cell provided the given most effective lift is not exceeded. This maximum lift is the larger, the less the obtuse angle-corner deviates from 90°, the efficiency improving with increasing angle obtuseness.

Figure 10:
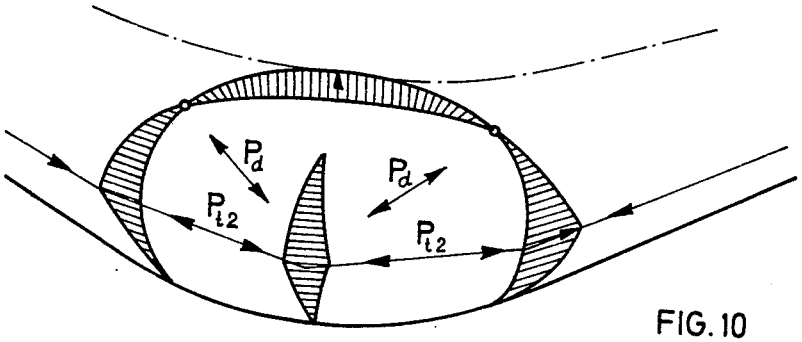
FIG. 10 shows the stresses at the corner seam of the power cell of FIG. 9.

FIG. 10 displays stresses occurring for the most effective lift at the corner-segment of a power-cell with a top view as shown in FIG. 9.

It is very easily feasible to reinforce the power-cell walls in those segments which are particularly loaded by the stresses, for instance by enclosing them with high-tensile-strength foils, for instance glass-fiber reinforced adhesive tapes, cloth-reinforced rubber foils, etc., whereby higher operational pressures are admissible or power-cells of larger volumes may be made of relatively thin foil.

It will be apparent to those skilled in the art that various modifications and variations could be made in the containers of the invention without departing from the scope or spirit of the invention.

What is claimed is:

1. A hollow body device for displacing masses by filling the device with pressurized fluid comprising:

a pair of like upper and lower planar segments, the periphery of said segments including rectilinear side portions, the like side portions being aligned and the shape of the segments being substantially unvarying as the device is pressurized;

a plurality of wall segments, each of said wall segments interconnecting respective ones of said aligned side portions of the planar segments, said wall segments varying in shape as the device is pressurized for providing a lift between the upper and lower segments and the wall segments developing part of a curved wall surface of a circular cylinder when the device is pressurized, the axis of the cylinder being orthogonal to the operational direction of the lift; and corner segments interconnecting adjoining ones of said wall segments, said corner segments varying in shape without substantial kinking as the device is pressurized.

2. A device as defined in claim 1, characterized in that the planar segments are square actuating surfaces.

3. A device as defined in claim 2, characterized in that the corner segments, when not inflated, so complement the wall segments that the overall topview of the device is geometrically similar to the shape of the actuating surfaces.

4. A device as defined in claim 2, characterized in that the corner segments are of such design that the outer edges of adjoining wall segments are smoothly joined by convex arc of a circle when the cell is not pressurized.

5. A device as defined by claim 2, characterized in that the corner segments are so designed that the outer edges of adjoining wall segments are joined by concave lines when the cell is not pressurized.

6. A device as defined in claim 2, characterized in that the corner segments are of such design that the outer edges of adjoining wall segments are joined by at least two rectilinear lines set meeting at an obtuse angle when the cell is not pressurized and wherein the overall top-view of the device, when pressurized, is substantially square but with rounded corners.

7. A device as defined by claim 6, including at least two flexible sheets imperviously connected to each other.

8. A device as defined in claim 1, comprising two flexible sheets imperviously interconnected along their rims.

9. A device as defined in claim 1, characterized in that wall segments jeopardized by stresses in the wall due to the displacement of masses are reinforced.

10. A device as defined in claim 9, characterized in that wall segments jeopardized by stresses in the wall due to the displacement of masses are reinforced by adhesive tape reinforced by glass fibers.

11. A device as defined in claim 9, characterized in that wall segments jeopardized by stresses in the wall due to the displacement of masses are reinforced by fabric-reinforced rubber foil.

12. A device as defined in claim 1, characterized in that the device is substantially a plane when the device is not pressurized.

* * * * *